United States Patent [19]

Vogt

[11] 3,943,517

[45] Mar. 9, 1976

[54] ADAPTIVE POLARIZATION RECEIVING SYSTEM

[75] Inventor: Gottfried F. Vogt, Lincroft, N.J.

[73] Assignee: The United States of America as represented by the Secretary of the Army, Washington, D.C.

[22] Filed: Oct. 29, 1974

[21] Appl. No.: 518,449

[52] U.S. Cl. ..... 343/100 PE; 325/369; 325/371

[51] Int. Cl.[2] ..... H01Q 21/24

[58] Field of Search..... 343/100 PE; 325/369, 371

[56] References Cited

UNITED STATES PATENTS

| | | | |
|---|---|---|---|
| 3,310,805 | 3/1967 | Viglietta et al. | 343/100 PE |
| 3,369,234 | 2/1968 | Bush et al. | 343/100 PE |
| 3,435,454 | 3/1969 | Vogt | 343/100 PE |

*Primary Examiner*—T. H. Tubbesing
*Assistant Examiner*—Richard E. Berger
*Attorney, Agent, or Firm*—Nathan Edelberg; Robert P. Gibson; Arthur L. Bowers

[57] ABSTRACT

The described signal receiving system includes control apparatus for making a system phase angle track the orientation angle of linear polarization of a radiated carrier, and for keeping substantially small any phase and amplitude distortions of the carrier which result from undesired polarization modulation.

3 Claims, 2 Drawing Figures

ADAPTIVE POLARIZATION RECEIVING SYSTEM

The invention described herein may be manufactured and used by or for the Government for governmental purposes without the payment of any royalties thereon or therefor.

FIELD OF THE INVENTION

This invention relates to signal receiving systems and, more particularly, to such a system in which perturbations in the propagation medium are compensated for improved operational performance.

BACKGROUND OF THE INVENTION

As is well known, one method of transmitting message information is to modulate the amplitude or phase of an electromagnetic carrier with message signal information. In so doing, it is the common practice to hold the orientation of the angle of linear polarization of the carrier constant — usually, but not necessarily, vertical or horizontal. As is also well known, when the ionosphere is used as the propagation medium for high frequency communication, it's electron content and the presence of the earth's magnetic field cause an undesirable change in the polarization angle of the electromagnetic wave. It has been further noted that the amplitude, frequency or phase characteristics of the wave are similarly affected in the time domain — with the overall result being a slowly varying fading in received signal strengths. This has been found especially prevalent in satellite communications, and requires critical receiver designs for acceptable system performance.

SUMMARY OF THE INVENTION

As will become clear hereinafter, the adaptive polarization receiving system of the present invention includes control apparatus to compensate for these effects. As will be seen, a polarization follower is employed to make the system phase angle track the orientation angle of linear polarization of the received carrier so that the receiver apparatus will follow polarization changes in the information signal. This apparatus will be seen to include a closed loop feedback network, in which an error signal is generated whenever the system phase angle differs from the incident polarization angle, and in which a control voltage is developed in response to be superimposed on a signal which scans the receiving antenna at a constant frequency.

At the same time, the error voltage is used to optimize the reproduction of the received message information in the presence of variations in incident polarization angle by off-setting the signal fading which results.

BRIEF DESCRIPTION OF THE DRAWING

These and other features of the present invention will be more clearly understood from a consideration of the following description taken in connection with the accompanying drawing in which.

DETAILED DESCRIPTION OF THE DRAWING

Figure 1:
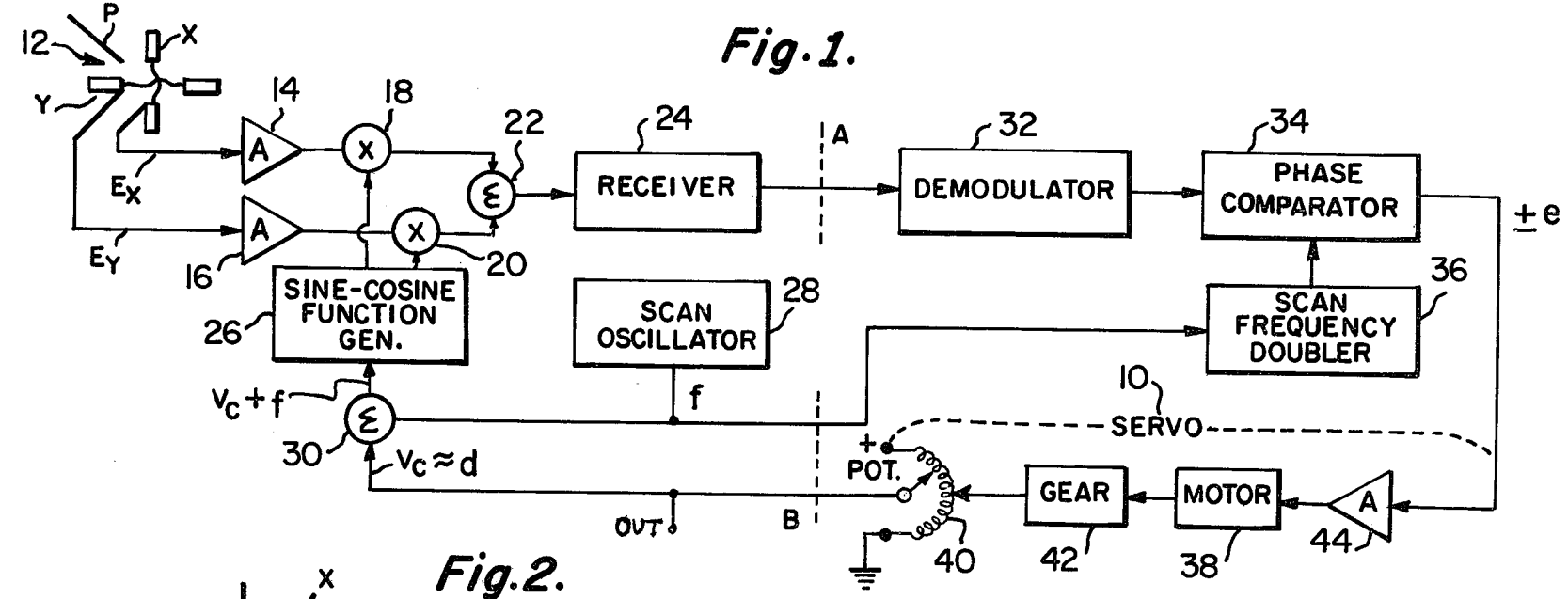
FIG. 1 is a schematic block diagram of a polarization follower system helpful in an understanding of the present invention.

The polarization follower of FIG. 1 is of the type described in U.S. Pat. Nos. 3,238,527, 3,435,454 and 3,524,139, in which the polarization of an antenna is swept by means of an appropriate scanning frequency onto which a DC control voltage is superimposed. As is therein described, that control voltage is a measure of the system phase angle, and when that angle differs from the incident polarization angle, a positive or negative error voltage is generated. Such voltage is used to control either the mechanical servosystems of these patents or the electronic servosystems described in U.S. Pat. Nos. 3,435,454 or 3,524,139.

Thus, more particularly referring to the block diagram of FIG. 1, it will be understood that a conventional mechanical servosystem 10 is connected between points A and B for tracking the incident polarization angle. An antenna 12 incorporates two crossed dipoles X and Y to receive the incident electromagnetic carrier wave having a Poynting vector P perpendicular to the antenna plane, and at the angle of linear polarization. The corresponding high frequency output signals from these polarization sensing antennas are designated as $E_X$ and $E_Y$, which are then fed through a pair of amplifiers 14, 16 to two corresponding modulators 18 and 20, designated as the X and Y multipliers respectively. As described in the afore-mentioned patents, the X multiplier 18 forms the product of $E_X$ with a magnitude of the cosine of the system phase angle while the Y multiplier 20 forms the product of $E_Y$ with a magnitude of the sine of that angle. The output products of the two multipliers 18 and 20 are summed in an adder 22, to form a composite signal $E_0$, which is then amplified, with the radio frequency components thereof being converted to intermediate frequencies, in the usual manner by a receiver 24.

A sine-cosine function generator 26 is also shown — being of a type described in U.S. Pat. No. 3,238,527. An oscillator 28 provides a scanning signal of appropriate frequency to be summed in an adder 30 with a DC voltage which varies as a function of the difference between the system phase angle and the incident polarization angle. Such varying direct voltage is provided by the servosystem 10 in a manner to minimize the intermediate frequency output from the receiver 24. To minimize this output, the servosystem 10 is incorporated as part of a closed feedback loop which also includes a demodulator 32, a phase comparator 34 and a frequency doubler 36.

More particularly, it will be seen that the output from the receiver 24 is applied to the demodulator 32, designed to pass the polarization information in providing a signal which serves as one input to the feedback loop. The scanning signal from oscillator 28 is applied to the frequency doubler 36, the output of which is provided the comparator 34 as a reference against which the demodulator signal is compared. Whenever the system phase angle differs from the incident polarization angle, the comparator 34 generates an error voltage which is applied to the servosystem 10 in adjusting the DC control voltage in a direction to reduce the angular difference to zero. With the closed loop operation, the two angles will be kept constant so that the control system will substantially follow any polarization changes of the received signal. As shown in FIG. 1, the error voltage generated controls the speed and direction of a motor 38 which, in turn drives a potentiometer 40 through a reduction gear 42 in providing the control voltage for the adder 30. Because the error voltage will be substantially small, an amplifier 44 is inserted between the comparator 34 and the motor 38.

As will be readily apparent, the control signal used to vary the outputs from the sine-cosine function generator 26 as the incident polarization changes is an alternating voltage onto which a varying direct voltage is superimposed. It will also be readily apparent that while such control signal could be used in orientating the system phase angle to coincide with the incident angle of polarization, such control signal could deleteriously affect the information modulation of the electromagnetic carrier. For this reason, while this control signal could be used to compensate for polarization distortions introduced by the ionospheric medium or the earth's magnetic field, the same control signal could not readily serve to compensate for the amplitude and phase distortions which the propagation medium introduces into the message information.

Such amplitude and phase distortions could be compensated, however, through the addition of a second, closed-loop feedback arrangement in which only a varying direct voltage is used to control the outputs from a sine-cosine function generator. As will be seen from the discussion which immediately follows, the system configuration is one in which a maximum direct voltage is developed when the system phase angle coincides with the incident angle of polarization — rather then a zero voltage being developed as in the configuration of FIG. 1. To accomplish this concept of utilizing a maximum control voltage for the communications network instead of the zero voltage as in the polarization adaptation, a 90° offset is designed into the system construction.

Figure 2:
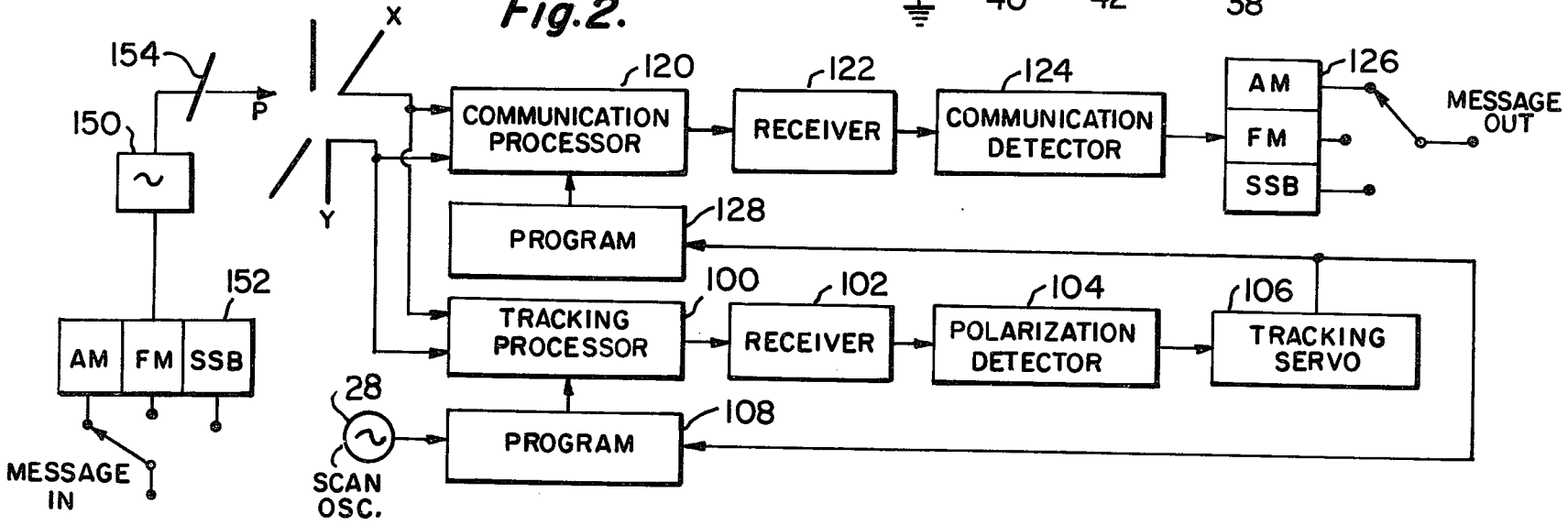
FIG. 2 is a schematic block diagram of the adaptive polarization receiving system embodying the invention.

Referring now, more particularly, to the schematic diagram of FIG. 2, the tracking processer 100 would include the amplifiers 14 and 16 of FIG. 1, the multipliers 18 and 20, and the adder 22. The receiver 102, the polarization detector 104 and the tracking servo 106 would, similarly, correspond to the receiver 24 of the first drawing, the demodulator 32, the phase comparator 34 and the scan frequency doubler 36 of that figure, and either the mechanical servomechanism 10 or the electronic servomechanisms previously referred to, respectively. The output of the tracking servo 106 is combined with the oscillatory signal from the scan oscillator 28, and applied to a programmer 108, comparable to the sine-cosine function generator 26 of FIG. 1. In accordance with the present invention, the tracking servo 106 — either of mechanical or electronic design — will provide not only the control voltage to be used in scanning the linear polarization of the antenna, but will also be used to optimize the operation in a communication processer of comparable construction to the tracking processer 100.

That is, a communication processer 120 is included, having a pair of amplifiers, a pair of multipliers and an adder similar to the construction shown at the upper-left hand portion of FIG. 1. A second programmer 128 is included, and similarly employs a sine-cosine function generator, whose outputs are multiplied as both sine and cosine of the incident angle of linear polarization with the $E_X$ and $E_Y$ signal components received by the antenna dipoles As in FIG. 1, the output adder of the processer 120 is followed by a receiver — in this case 122 — which converts the radio frequency components to intermediate frequency signals for further processing in a communications detector 124 of appropriate demodulator construction. Further processing equipments would couple to the output of the detector 124 in conventional manner, and of a type dependant upon whether the information is impressed on the electromagnetic carrier either as amplitude modulation, frequency modulation, or single side-band, as denoted by the block 126 of FIG. 2.

In further accordance with the invention, moreover, the control voltage to be supplied the sine-cosine function generator of the communications programmer 128 is effectively supplied with a 90° phase difference from the control voltage utilized in the tracking programmer 108 in order to utilize the communications network as operative from a "maximum signal tracking" standpoint rather than from a "null seeking tracking" standpoint as utilized in the apparatus of FIG. 1. To this end, for the block diagram arrangement of FIG. 2 where a mechanical servomechanism would be employed in the feedback loop for the tracking processer, a second such servomechanism arrangement could be incorporated for the communication programmer, but operative in a construction wherein a 90° phase shifter were inserted between the scan oscillator 28 and the scan frequency doubler 36 of FIG. 1. On the other hand, if an electronic servomechanism of the type described in U.S. Pat. No. 3,435,454 or 3,524,139 were employed, then the error voltage developed could be used in an arrangement where the pulse timing sequences are altered to, in effect, develop the same 90° phase shift as with the mechanical servo system. As will be readily appreciated, the control voltages thus provided the sine-cosine function generator for the communication programmer 128, in either event, would serve to keep the expression $\sin^2 d + \cos^2 d = 1$, ($d$ being the incident angle of polarization), in order to maximize the output from the communication receiver 122 even though changes in linear polarization would be present to effect phase and amplitude distortions in the information content.

With this arrangement, imparted message information which serves to modulate a carrier, as in block 150 of FIG. 2, may be either amplitude modulation, frequency modulation or in single side-band format, as illustrated by the block 152. When transmitted via antenna 154 with fixed polarization, the above described arrangement operates to offset the signal fading which would otherwise be introduced as the angle of polarization is changed due to perturbations in the transmission medium. One portion — mainly the tracking portion for maintaining the system phase angle equal to the incident angle of linear polarization — will thus be seen to control the communications portion in recovering the message information transmitted. However, it will be seen that the FIG. 2 construction eliminates the alternating voltage upon which the direct voltage control signal was superimposed in scanning the antenna elements. As far as the communication reproduction is concerned, it will readily be appreciated that more of a steady-state or quiescent condition is required in which the programmer input is changed only during the presence of signal fading.

While there has been described what is considered to be a preferred embodiment of the present invention, it will be understood that modifications may be made by those skilled in the art without departing from the scope of the teachings herein, of utilizing a first branch to track the minimum, or null, of a polarization pattern, and a second branch to align the maximum of the pattern in the direction of the received polarization vector. For example, in the FIG. 2 embodiment of the invention using a mechanical servomechanism, it will be seen that the second servosystem could be deleted by coupling a sine-cosine potentiometer to the mechanical shaft of potentiometer 40, at which point the analog output signal is developed — mechanical rotation by 90° would then provide for reception at the pattern maximum, while permitting, at the same time, the elimination of the second function generator, as well. For this reason, reference is to be had to the appended claims in determining the scope of the described invention.

I claim:

1. In a radio communication system of the type including a signal receiver, a pair of quadrature positioned cross dipole antennas for recovering intelligence information for reporduction by said receiver, and means for producing signal components of the angle of polarization of an incident wave of high frequency energy received thereby, the combination therewith of:

first polarization follower apparatus for providing a first, variable control signal that comprises a variable direct voltage superimposed onto an alternating signal to maintain the system phase angle in synchronization with the incident polarization angle of said high frequency wave; and second polarization follower apparatus for providing a second variable control signal that comprises substantially only a variable direct voltage 90° displaced in phase with respect to said first control signal to decrease the sensitivity of said receiver to distortion in intelligence information due to undesired polarization modulation caused by perturbations in the propagation medium.

2. The combination of claim 1 wherein said direct voltages vary as a function of the phasor difference between said system phase angle and said incident polarization angle.

3. The combination of claim 2 wherein said signal receiver reproduces AM, FM or single side-band intelligence information.

* * * * *